US005974929A

United States Patent [19]

Kugel et al.

[11] Patent Number: 5,974,929

[45] Date of Patent: Nov. 2, 1999

[54] COMBINED LETTER OPENER AND LETTER PUNCH

[75] Inventors: Ofer Kugel, Haifa; Eliahu Doron, Kirvat Motzkin, both of Israel

[73] Assignee: D.G.D Haifa Ltd., Atlit, Israel

[21] Appl. No.: 08/825,483

[22] Filed: Mar. 28, 1997

Related U.S. Application Data

[63] Continuation-in-part of application No. 08/567,633, Dec. 5, 1995, abandoned.

[30] Foreign Application Priority Data

Dec. 9, 1994 [IL] Israel ..... 111941

[51] Int. Cl.[6] ..... B26D 9/00; B43M 7/00

[52] U.S. Cl. ..... 83/582; 83/588; 83/618; 83/633; 83/636; 83/682; 83/694; 83/699.11; 83/912

[58] Field of Search ..... 83/588, 681, 682, 83/912, 934, 467.1, 468.1, 582, 589, 618, 633, 695, 698.31, 699.11, 694, 636

[56] References Cited

U.S. PATENT DOCUMENTS

| | | | |
|---|---|---|---|
| 145,292 | 12/1873 | Gathright | 83/682 X |
| 483,555 | 10/1892 | Hersey | 83/682 X |
| 766,388 | 8/1904 | Robertson | 83/167 X |
| 929,233 | 7/1909 | Mason | 83/635 X |
| 938,741 | 11/1909 | Campbell | 83/167 |
| 973,347 | 10/1910 | Evon | 83/167 |
| 1,005,879 | 10/1911 | Ries | 83/167 |
| 1,126,542 | 1/1915 | Marks | 83/167 X |
| 1,139,572 | 5/1915 | Perry | 83/167 |
| 1,167,999 | 1/1916 | Hendee | 83/167 |
| 1,208,829 | 12/1916 | Porter | 83/167 |
| 1,265,844 | 5/1918 | Washburne | 83/167 |
| 1,292,181 | 1/1919 | Webb | 83/167 |
| 1,436,006 | 11/1922 | Beans | 83/682 |
| 1,447,247 | 3/1923 | Hilsdorf | 83/167 |
| 1,624,590 | 4/1927 | Fleming | 83/167 |
| 1,750,411 | 3/1930 | La Bauve | 83/167 X |
| 1,864,830 | 6/1932 | Johnson | 83/167 X |
| 2,266,629 | 12/1941 | Flynn | 83/167 |
| 2,513,075 | 6/1950 | Youngstrand | 83/167 X |
| 3,248,988 | 5/1966 | Janczy | 83/682 |
| 3,368,441 | 2/1968 | Piazze | 83/682 X |
| 3,726,164 | 4/1973 | Cocquebert | 83/588 X |
| 3,750,502 | 8/1973 | Ball | 83/682 X |
| 3,861,262 | 1/1975 | Carpenter et al. | 8/642 |
| 3,927,589 | 12/1975 | Emkjer et al. | 83/167 X |
| 4,199,863 | 4/1980 | Deckert | 83/167 X |
| 4,527,455 | 7/1985 | Morax | 83/588 |
| 4,651,610 | 3/1987 | Schwelling | 83/636 |
| 4,711,031 | 12/1987 | Annello | 30/294 |
| 4,754,676 | 7/1988 | Wessels | 83/588 X |
| 4,787,283 | 11/1988 | Foster | 83/682 X |
| 4,873,767 | 10/1989 | Lok | 30/278 |
| 4,875,274 | 10/1989 | Foster | 83/682 X |
| 5,090,285 | 2/1992 | Kondo | 83/636 |
| 5,099,671 | 3/1992 | Beaulac | 83/662 X |
| 5,163,350 | 11/1992 | Groswith, III et al. | 83/618 X |

FOREIGN PATENT DOCUMENTS

| | | | |
|---|---|---|---|
| 121274 | 4/1946 | Australia | 83/682 |
| 517027 | 4/1921 | France | 83/682 |
| 178761 | 11/1906 | Germany | 83/588 |
| 2181085 | 4/1987 | United Kingdom | B23P 17/00 |

*Primary Examiner*—Clark F. Dexter

*Attorney, Agent, or Firm*—Schweitzer Cornman Gross & Bondell, LLP

[57] ABSTRACT

The invention provides a device for cutting open envelopes and punching filing holes into documents, and includes a body coupled to a base, the base having a two-section feeding surface along which an envelope, or other one or more documents are introduced into the device. The base is provided with a slot extending across the base, and a cutting blade having at least one cutting edge and being slidably guided in the slot, at least a portion of an edge of the slot in the base serving as stationary counter-edge to the cutting blade. At least two hole punches are slidably guided in a first section of the body; a corresponding member of cutting die holes are located in the body. A pressure-applying handle is hingedly articulated to the body for causing both the cutting blade and the hole punches to move towards the two-section feeding surface. First and second restoring springs respectively cause the cutting blade and the punches to move away from the feeding surface when the pressure-applying handle is released.

5 Claims, 5 Drawing Sheets

COMBINED LETTER OPENER AND LETTER PUNCH

This application is a continuation-in-part of U.S. patent application Ser. No. 08/567,633, filed on Dec. 5, 1995, now abandoned.

FIELD OF THE INVENTION

The present invention relates to a letter opener.

BACKGROUND OF THE INVENTION

Envelopes today are generally opened in two ways: either by the tear-open-and-hope-for-the-best method, which is primitive, rather messy and more often than not results in damage to the envelope's contents, or with the aid of the stiletto-like letter knife. The problem with the latter is that its tip must be introduced into whatever small gap may exist between the edge of the envelope and the gummed and sealed part of the flap. Such a gap having been located and the knife inserted, it is then pulled along the length of the flap, while the envelope is held immobile. This procedure is not only time-consuming and demands an undue amount of attention, but it often happens that, while being introduced into the envelope, the knife also slips into a fold of the letter or document enclosed in the envelope, with predictable results.

It is thus one of the objects of the present invention to provide a letter opener that works rapidly, safely and reliably, without demanding particular attention and carefulness.

SUMMARY OF THE INVENTION

According to the invention, the above object is achieved by providing a device for cutting open envelopes and punching filing holes into documents, comprising a body mounted on, or integral with, a base, said base having a two-section feeding surface along which an envelope, respectively one or more documents, are introduced into said device, said base being provided with a slot extending in a direction substantially perpendicular to the direction in which said envelopes or documents are introduced into said device; a cutting blade having at least one cutting edge and being slidably guided in said slot, at least a portion of an edge of said slot in said base serving as stationary counter-edge to said cutting blade; at least two hole punches slidably guided in said body at a mutual distance equal to the distance between the holes of the standard perforation used for the filing of letters and documents, with one hole provided in said base for each of said punches, serving as cutting dies therefor; pressure-applying means hingedly articulated to said body for causing both said cutting blade and said hole punches to move towards said two-section feeding surface, and first and second restoring means for respectively causing said cutting blade and said punches to move away from said feeding surface when said pressure-applying means is released.

The invention will now be described in connection with certain preferred embodiments with reference to the following illustrative figures so that it may be more fully understood.

With specific reference, now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EMBODIMENTS

Figure 1:
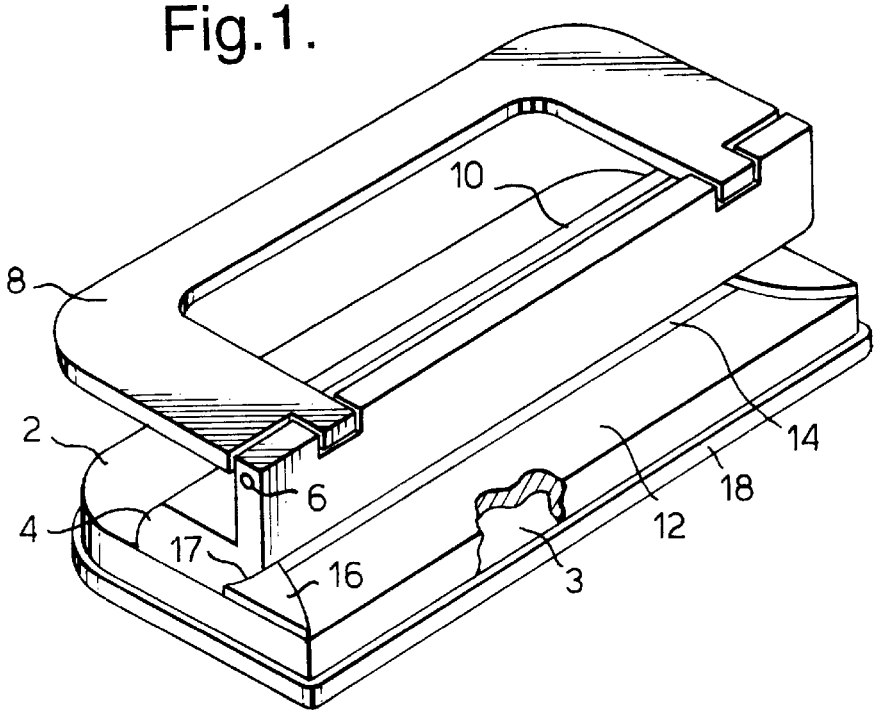
FIG. 1 is a general, perspective view of one of the embodiments of the device according to the invention.

Referring now to the drawings, there is seen in FIG. 1 a hollow base 2 on which is mounted, or with which is integral in alternative designs, a body 4 to which a pressure-applying means in the form of a handle 8 is hinged by means of pivots 6. As will be seen in subsequent figures, handle 8 is adapted, when depressed, to act on a cutting blade 10 slidably mounted in body 4, causing it to descend. Base 2 is provided with a feeding surface 12, along which an envelope to be cut open is introduced into the device. Advantageously, there is also provided, flush with the feeding surface 12, a stationary counterblade 14 of which, in this drawing, only the rear edge is seen. The cutting action takes place between the front edge of counterblade 14 and the descending cutting blade 10. Further seen are two guide plates 16, mounted on the feeding surface 12 and providing a flaring entrance, facilitating the introduction of an envelope. The same purpose is served by the rounded edge 17.

The hollow 3 of base 2 serves as a receptacle for the paper slivers $P_s$ (see FIG. 6) cut off from the envelopes. It is covered by a lid 18, advantageously made of an at least semi-transparent plastic to facilitate emptying.

Figure 2:
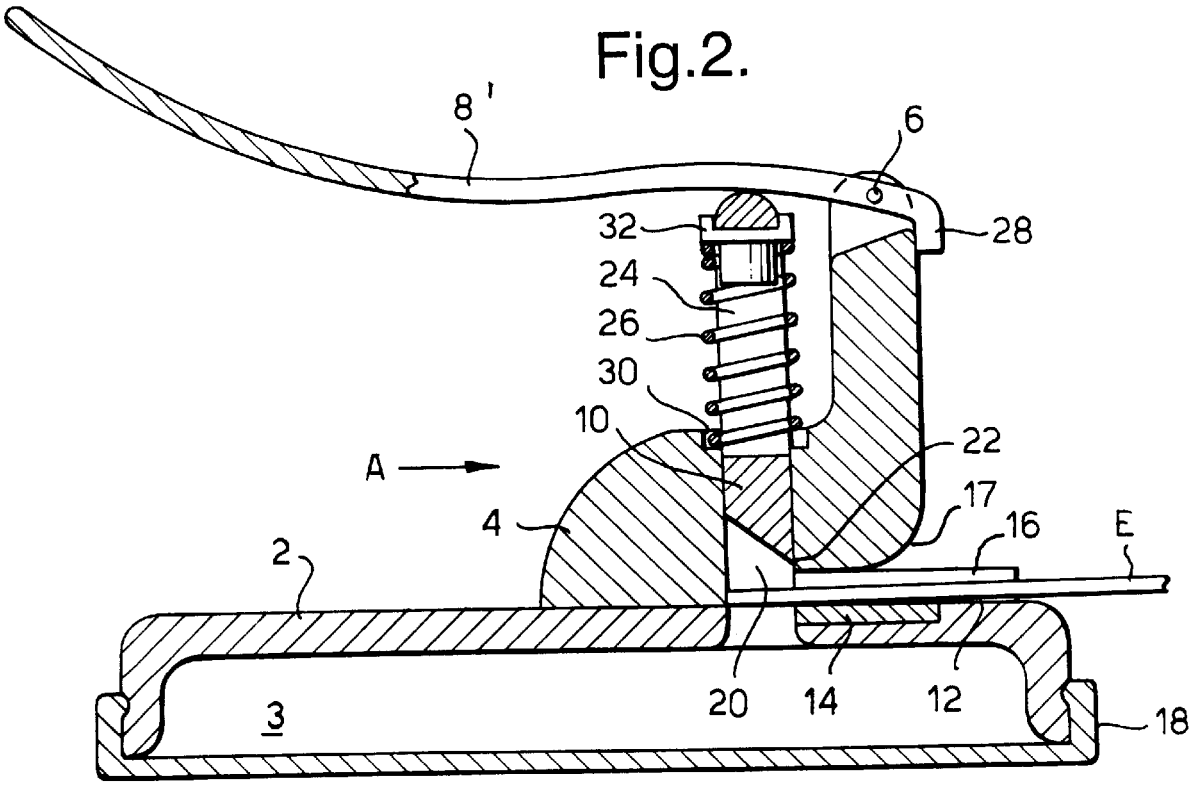
FIG. 2 illustrates another embodiment of the device, along with a portion of the blade shown in cross-section along plane II—II of FIG. 3.

FIG. 2 represents a first embodiment of the device according to the invention. There is seen the hollow base 2 with its lid 18 and body 4, to the upright portion of which handle 8' is articulated by means of pivot 6. There is also seen a slot 20 passing through body 4 and base 2, in which slot is slidably mounted cutting blade 10, seen to better advantage in FIGS. 3 and 4. Blade 10, as seen in these Figures, has two cutting edges 22, which include an obtuse angle. This V-type blade has the advantage of reducing the blade stroke required for cutting open an envelope of a given width. Further seen are two window-like openings 24, the purpose of which will be explained further below. The upper edge of cutting blade 10 is advantageously rounded off, at least at its point of contact with handle 8.

Also shown is the feeding surface 12 with its guide plates 16 and steel counter-blade 14, which is flush with feeding surface 12 and fixedly attached to base 2. Also seen is an envelope E, ready to be cut open.

Figure 4:
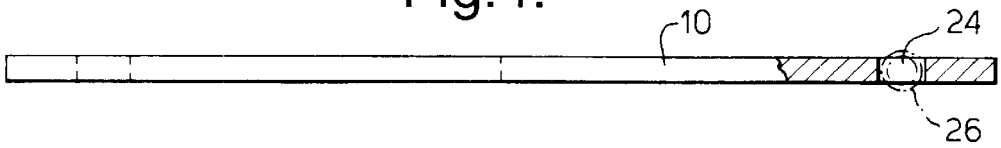
FIG. 4 is a top view of the blade as seen in partial cross-section along plane IV—IV in FIG. 3.

Windows 24 in blades 10 serve to accommodate helical springs 26, as clearly indicated in FIG. 4. These springs 26, compressed when handle 8, and thereby, blade 10, are forced down, provide the restoring force to return both blade 10 and handle 8' to their position of rest, which is defined, in this embodiment, by the bent-over ends 28 of the arms of handle 8' abutting against the upright portion of body 4.

Figure 5:
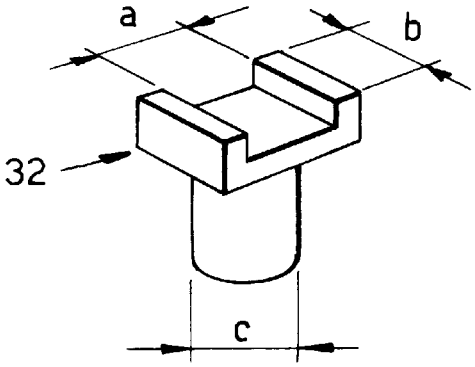
FIG. 5 is a perspective view of the head piece of FIG. 2.

Springs 26 must, of course, be prevented from moving out from windows 24 in a lateral direction. This is advantageously achieved by a shallow countersink 30 that stabilizes the lowermost turn of springs 26, and a head piece 32, illustrated in FIG. 5, in which a is the thickness of blade 10; b is the width of windows 24 and c is the inside diameter of helical springs 26. Head piece 32 'locks' the uppermost turn or turns in position.

Another means of retaining springs 26 within windows 24 would be, e.g., the provision, at the upper end of windows 24, of a projection that would fit the inside diameter of springs 24, preventing their escape from windows 24.

In this embodiment, the width of the paper strip to be cut off the envelope E is determined by the width of slot 20, the rear wall of which, as can be seen in FIG. 2, serves as a stop means for the envelope E when it is introduced into the device.

Figure 6:
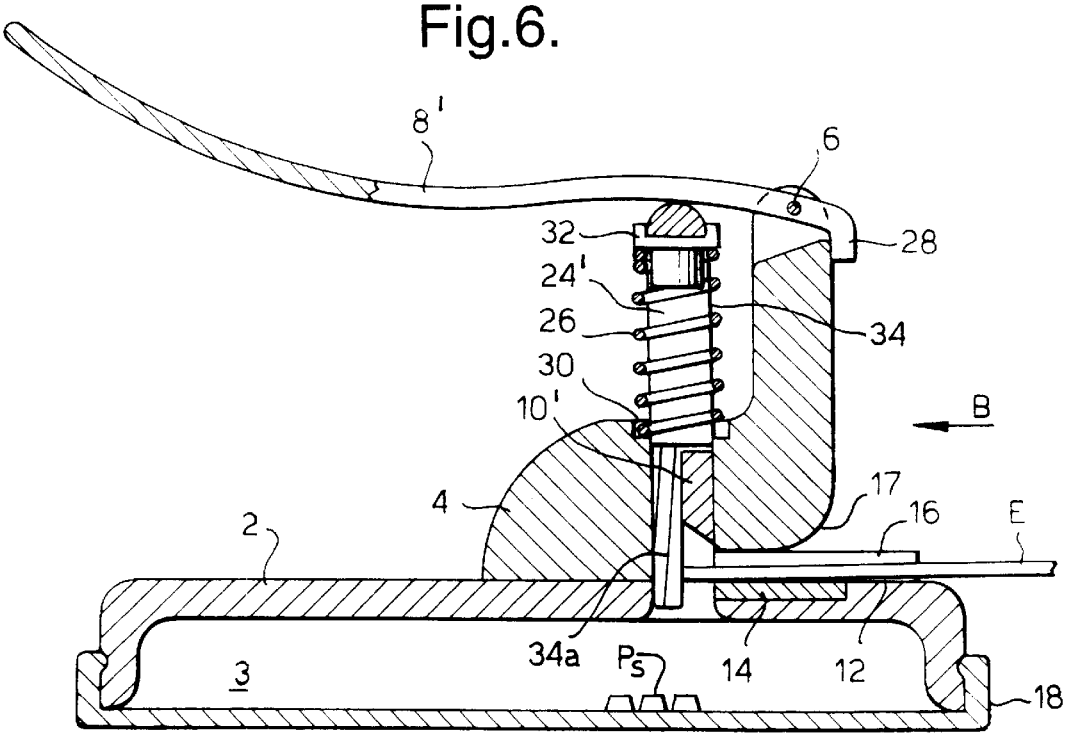
FIG. 6 represents yet another embodiment, which is provided with a cutting-blade carrier.
Figure 7:
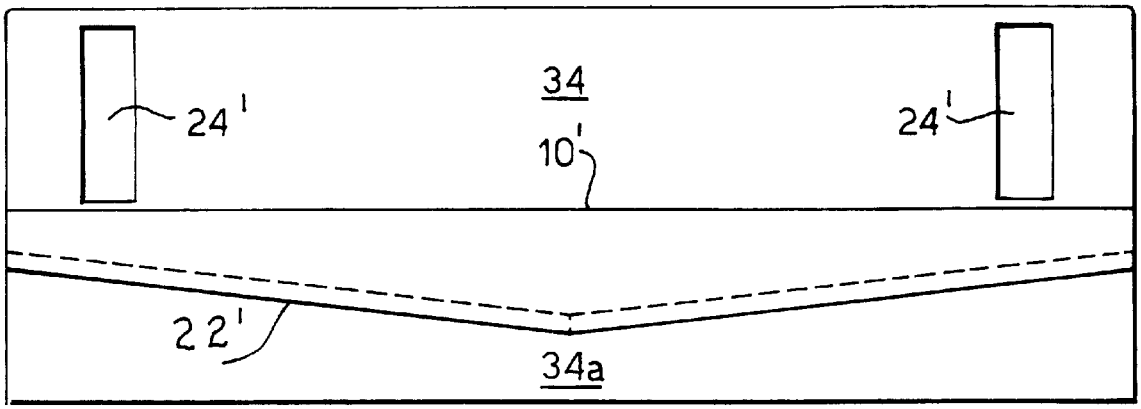
FIG. 7 is an elevation of the blade carrier and the blade of FIG. 6, as seen in the direction of arrow B in FIG. 6.

The embodiment represented in FIGS. 6 and 7 differs from the embodiment of FIG. 2 in an important detail: the cutting blade proper, 10', made of quality steel, is fixedly attached to a blade carrier 34 which also comprises the window-like openings 24', while its lower part 34*a* serves as stop for the envelope E, as clearly seen in FIG. 6.

Figure 8:
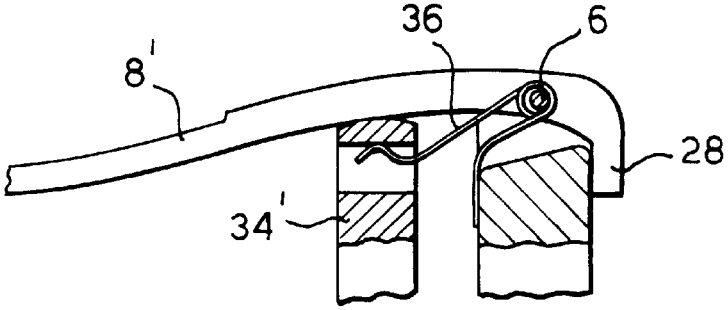
FIG. 8 shows a torsion spring which replaces the helical springs of the previous embodiments.

In the embodiment of FIG. 8 there are provided torsion springs 36, which replace the helical springs 26 of the previous embodiments. These torsion springs 36 are mounted on pivots 6, with one arm abutting against the upright portion of body 4, and the other acting on blade carrier 34 and, thereby, also on handle 8'. These torsion springs 36 obviously make windows 24' superfluous.

Cutting is effected by a shearing action taking place between the descending cutting blade 10, 10' and the stationary counter-blade 14.

While the cutting edges 22, 22' shown are all V-type edges, other configurations of blade cutting edges are, of course, possible. Such configurations would include straight or slanting, as well as curved, cutting edges.

Although the device according to the invention was described with a view to its use as a letter opener, it will be appreciated that it can also be used for general paper cutting and trimming purposes.

Figure 9:
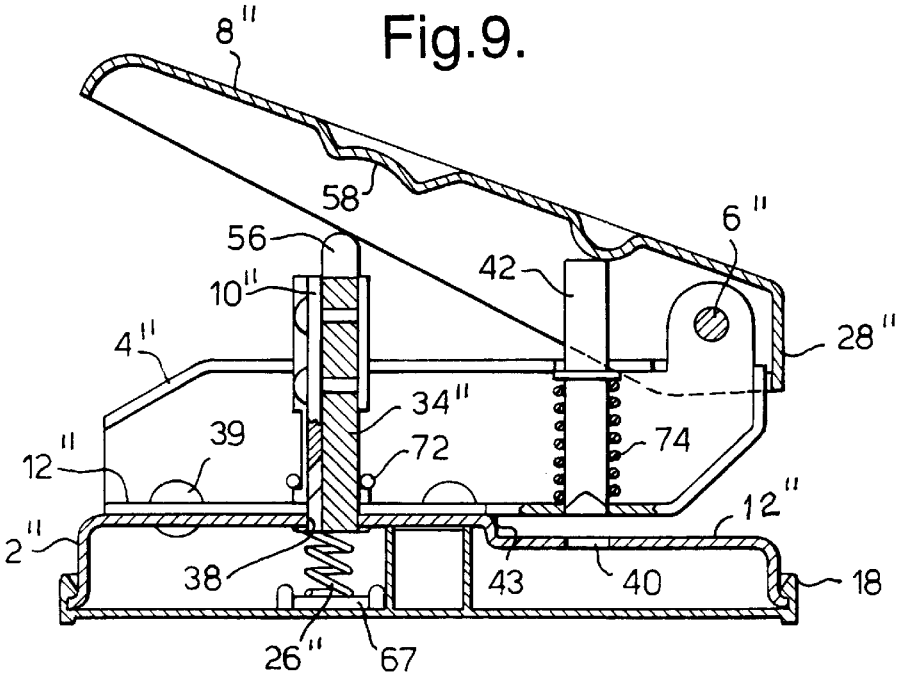
FIG. 9 is a cross-sectional view of yet another embodiment of the invention, in which a paper punch has been combined with the letter opener according to the invention.

FIG. 9 is a cross-sectional view of another embodiment in which a paper punch has been combined with the letter opener according to the invention, both being activated by one and the same handle.

Seen is base 2", including a two-section feeding surface 12", advantageously made of steel, as it provides both the stationary counter-edge 38 for blade 10" and dies 40 for punches 42, counter-edge 38 being one of two edges defining a slot 45. In the region opposite to punches 42, base 2" is slightly stepped down to allow for a substantial number of sheets to be perforated simultaneously, as well as to provide a stop 43 defining the distance of the perforations from the sheet edge.

Body 4" in this embodiment has the shape of two separate, advantageously press-formed members of a substantially U-shaped profile fixedly attached to base 2", e.g., by means of rivets 39, with the wings of the profiles facing one another.

Figure 10:
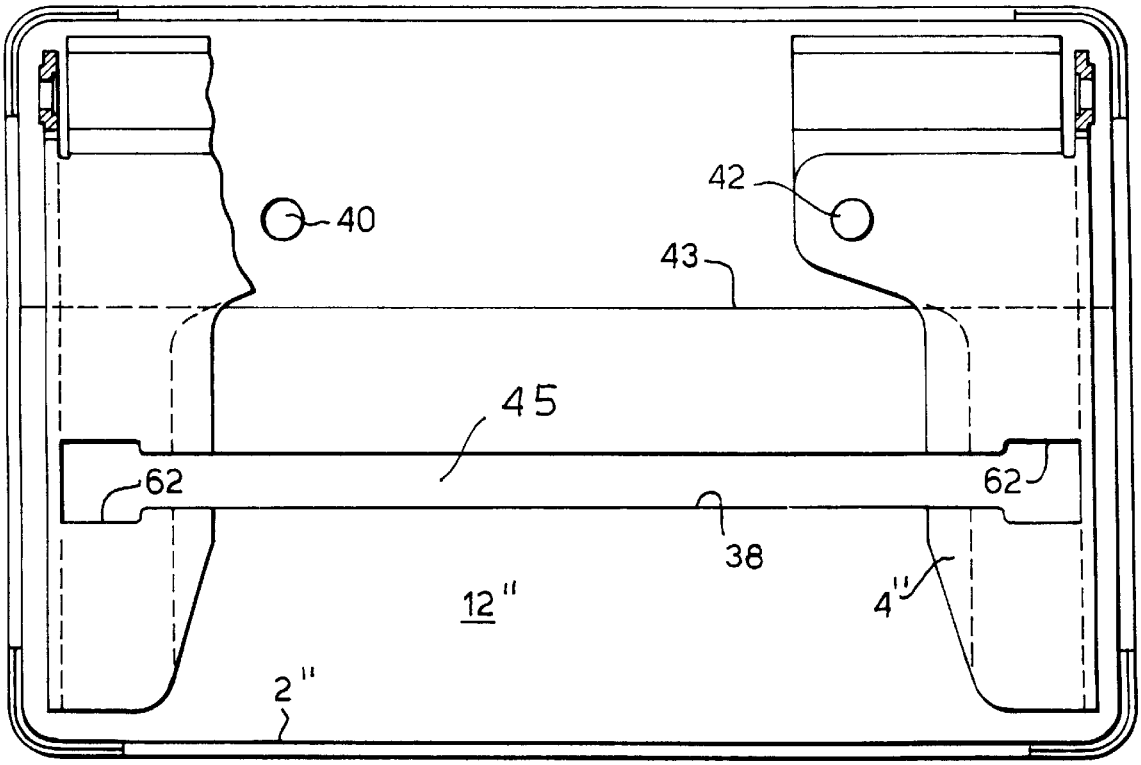
FIG. 10 is a top view of the embodiment of FIG. 9, showing only the base and the body of the device.

The outlines of base 2" and body 4" are clearly seen in FIG. 10, which is a top view of the device, with a pressure-applying means in the form of a handle 8" having a bent-over end 28", pivot 6", one of the punches 42, blade 10" and blade carrier 34" removed.

Figure 3:
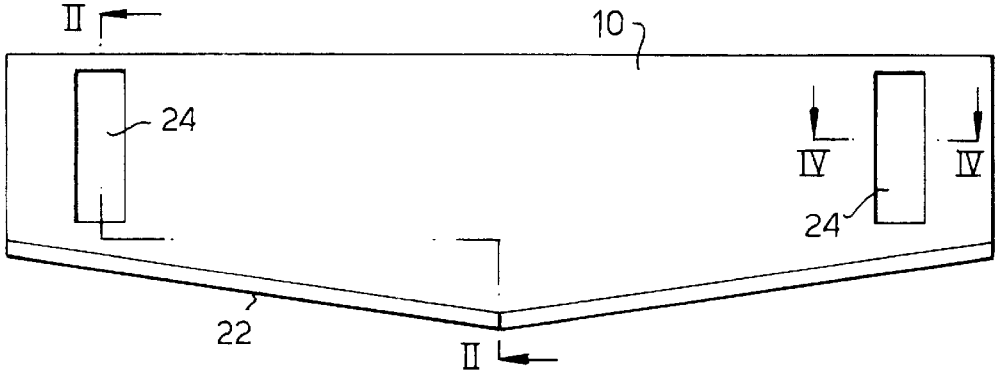
FIG. 3 is an elevational view of the cutting blade as seen in the direction of arrow A in FIG. 2.
Figure 11:
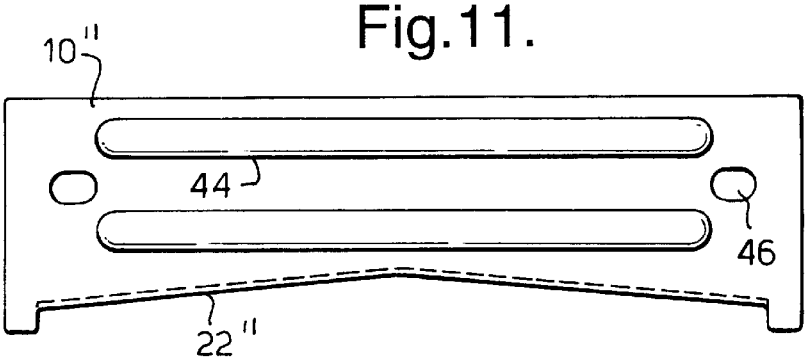
FIG. 11 illustrates the cutting blade of the embodiment of FIG. 9.
Figure 12:
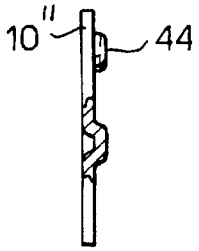
FIG. 12 is a side view, in partial cross-section, of the blade of FIG. 11.

Cutting blade 10" (FIGS. 11, 12), in contradistinction to blade 10, 10' in FIGS. 3 or 7, has cutting edge 22' that include a re-entrant angle. Also seen are ribs 44, preferably press-formed, which serve to rigidify the relatively thin blade 10". Also shown are two slightly elongated holes 46 through which, as will be explained presently, blade 10" is kinematically connected to blade carrier 34".

Figure 13:
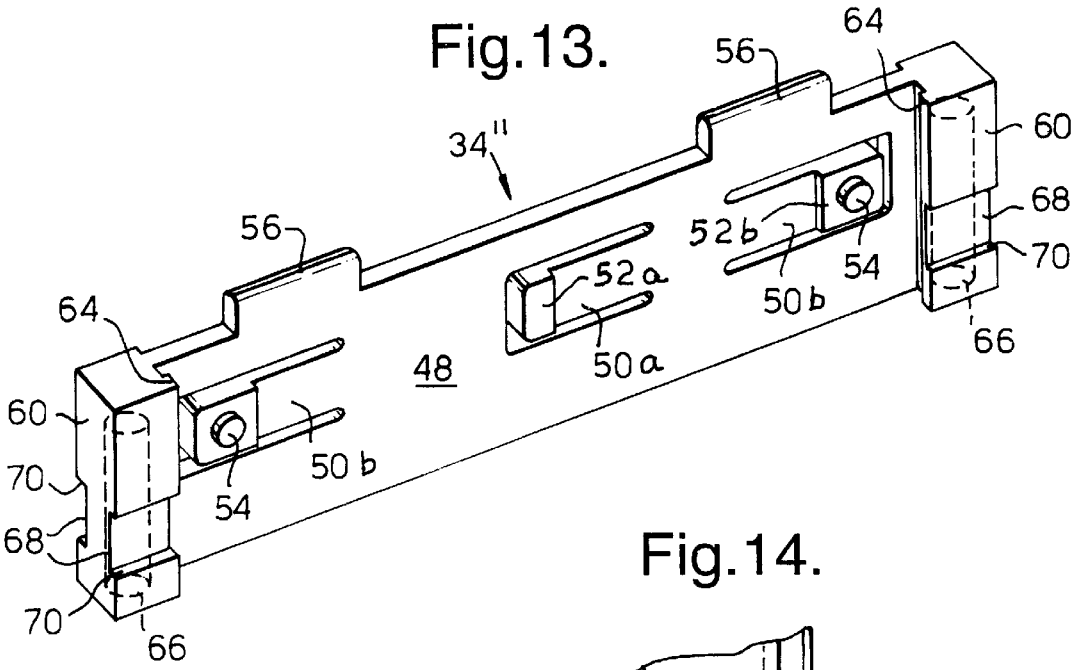
FIG. 13 is a perspective view of the blade carrier for the blade of FIG. 11.

Blade carrier 34" is shown in the perspective view of FIG. 13 and is advantageously made of a plastic material. It is seen to consist of a flat body 48 with which are integral three springy, i.e., elastically deformable tongues 50*a*, 50*b*, regions 52*a*, 52*b* of which protrude beyond the frontal surface of body 48. First and third tongues 50*b* are also provided with substantially cylindrical projections 54, the diameters of which fit the above-mentioned elongated holes 46 in blade 10 and which, in fact, serve as the drivers of blade 10" when handle 8" (FIG. 9) is depressed, in which state two lugs 56 provide contact with appropriately located hollows 58 in handle 8" (FIG. 9). The provision of two spaced-apart lugs 56 prevents jamming due to skewing.

Further seen are two guide posts 60 slidingly fitting appropriately aligned openings 62 in both bodies 4" and base 2", guiding blade carrier 34" in the vertical cutting movement produced by depressing handle 8".

Small ledges 64 define a shallow groove slightly wider than the thickness of blade 10", into which groove, upon assembly of the device, blade 10" is slid past the temporarily deflected tongues 50*a*, 50*b*, until projections 54 snap into the elongated holes 46 in blade 10. The purpose of tongue 50*a*, 50*b* is clearly to always press cutting edges 22" against counter-edge 38.

Posts 60 also comprise bores 66 (shown in dashed lines) which accommodate restoring means in the form of helical restoring springs 26" (FIG. 9). Springs 26" rest on lugs 67 (FIG. 1) integral with, and raised from, base 2".

Figure 14:
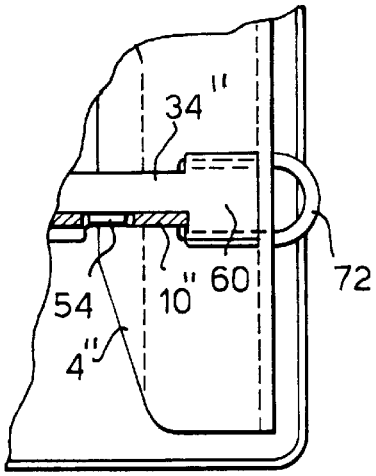
FIG. 14 is a partial top view of the device, showing one of the retaining clips.

Further seen are shallow recesses 68 which provide upper and lower abutment shoulders for a U-shaped retaining clip 72 (FIGS. 9 and 14), thus defining the uppermost and lowermost positions of blade carrier 34" and blade 10". The two punches 42, guided in bodies 4", are of the well-known type and, for mechanical advantage in multi-layer punching, are arranged close to pivot 6" of handle 8". Their mutual distance obviously conforms to the distance between the two holes of the standard perforation used for the filing of letters and documents. Helical springs 74 serve to restore punches 42 to their position of rest when handle 8" is released.

It will be appreciated that for standards prescribing more than two holes, more than two punches 42 can be provided.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A device for cutting open envelopes and punching filing holes into documents, comprising:

a body coupled to a base, said base having a two-section feeding surface having a first section for accepting the documents to be punched from a first direction and a second section for accepting the envelopes to be cut open from a second direction, said second section being provided with a slot extending across said base;

a blade carrier movably supported by said body and supporting a cutting blade having at least one cutting edge, said blade carrier slidably guiding said cutting blade into said slot, wherein at least a portion of an edge of said slot in said base serves as a stationary counter-edge that cooperates with said cutting blade and wherein said blade carrier has at least one elastically deformable member continuously pressing the cutting blade towards a plane containing the stationary counter-edge;

at least two hole punches movably supported by said body and slidably guided into said first section of said feeding surface, with a corresponding number of holes provided in said base for said punches, each of the holes serving as a cutting die for an individual one of the punches;

pressure-applying means hingedly articulated to said body for causing both said cutting blade and said hole punches to move towards and into said two-section feeding surface, and first and second restoring means respectively associated with said cutting blade and said punches to cause the cutting blade and punches to move away from said feeding surface when said pressure-applying means is released.

2. The device in claim 1, wherein said at least one cutting edge of said cutting blade comprises two intersecting cutting edges forming a re-entrant angle therebetween.

3. The device as claimed in claim 1, wherein at least one of the elastically deformable members has at least one projection located thereon, each said projection engaging in a respective opening provided in said cutting blade.

4. The device as claimed in claim 1, wherein said punches are arranged closer to a point of articulation of said pressure-applying means than is said cutting blade.

5. The device as claimed in claim 1, wherein said first and second restoring means are helical springs.

* * * * *